United States Patent [19]

Zoni

[11] Patent Number: 4,754,521

[45] Date of Patent: Jul. 5, 1988

[54] STREET SWEEPER MACHINE FOR TRASH COLLECTING

[75] Inventor: Sergio Zoni, Parma, Italy

[73] Assignee: Dulevo S.p.A, Sanguinaro di Fontanellato, Italy

[21] Appl. No.: 901,031

[22] Filed: Aug. 27, 1986

[30] Foreign Application Priority Data

Jul. 31, 1986 [IT] Italy ..... 48338 A/86

[51] Int. Cl.[4] ..... E01H 1/04

[52] U.S. Cl. ..... 15/340; 15/84; 15/87; 15/348

[58] Field of Search ..... 15/340, 348, 87, 84

[56] References Cited

U.S. PATENT DOCUMENTS

| | | | |
|---|---|---|---|
| 451,723 | 5/1891 | Gordon | 15/84 |
| 1,255,519 | 2/1918 | Ellis | 15/84 |
| 1,273,998 | 7/1918 | Brajdovics | 15/84 |
| 1,507,243 | 9/1924 | Meyer | 15/348 |
| 2,996,742 | 8/1961 | Aimers et al. | 15/87 |
| 3,293,679 | 12/1966 | Murphy | 15/84 |
| 3,436,788 | 4/1969 | Tamny | 15/87 X |
| 3,649,982 | 3/1972 | Mortensen | 15/84 |
| 4,308,632 | 1/1982 | Dickson et al. | 15/87 |
| 4,414,699 | 11/1983 | Hirt | 15/87 |
| 4,580,312 | 4/1986 | Van Raaij | 15/340 X |

*Primary Examiner*—Chris K. Moore

*Attorney, Agent, or Firm*—Browdy and Neimark

[57] ABSTRACT

A machine with a frame supporting two side brushes downwardly, a center roller, and an auxiliary front brush movable on command in a crosswise direction to the frame, and upwardly a driver's cab, a trash container, a water tank and a trash conveyor. The water tank and trash conveyor are of reduced dimensions (i.e., short) with respect to the machine lengthwise direction are flattened and inserted between the cab and container. The conveyor has an open structure which extends vertically in an air-tight transport channel between a top end in communication with the container via an opening in the container and a bottom end placed forwardly close to the center roller. A dust suction unit is also provided in communication with the container interior, to draw in dust raised by said brushes through the opening into the trash container from a transport channel between the bottom and top ends of the conveyor.

12 Claims, 4 Drawing Sheets

1
2
2a
2b
3
4a
4b
5
6
7
8
9
10
15
16
18
19
20
21
21a
21b
22
23
24a
25
26
27
28
29
30
30a
30b
31
32
33
35
36
38
39
53
54

STREET SWEEPER MACHINE FOR TRASH COLLECTING

BACKGROUND OF THE INVENTION

This invention relates to a street sweeper machine for trash collecting.

Known type street sweepers intended for cleaning large surfaces, such as streets, generally have a driver's cab, a storage tank for the water to be sprinkled over the ground to wet it prior to removing trash and to prevent dust raising, a container for trash picked up from the ground, and a number of brushes in direct contact with the ground.

Necessary in each machine of the aforesaid type, which are expected to operate continuously for many hours every day, are in particular a container for trash and a large capacity tank, in order to provide adequate range and avoid frequent stops for unloading trash and refilling with water. Also appropriate is a driver's cab to prevent him from becoming excessively tired.

It is also generally arranged for the brushes to include on each machine both side brushes of cup-like shape and a cylindrical brush or roller, located substantially centrally on the machine and forming the main element at work over the ground.

The cup-like brushes include, in turn, at least two adjustable level side brushes substantially within the machine outline and serving the purpose of directing removed material or trash to underneath the machine and towards the main center roller.

The center roller is also usually adjustable in level and serves to both sweep the ground and thrust all the trash, including that from the side brushes, toward the interior of the trash container.

In many cases the container accommodates an auxiliary roller on its interior which is driven off the main roller through a belt drive and is arranged to favor the trash movement into the container by boosting the thrusting action of the main roller and prevent trash from moving out especially where large size trash is involved.

Both at said brushes and, especially, at the main center roller, water sprinkling nozzles are provided which are connected to the cited water storage tank and a pump. The water sprinkled toward the ground traps down the dust raised by the cup-like brushes and the roller.

In particular an array of sprinklers and a strong sprinkling action at the very location of the main center roller are provided, since the same performs a trash raising and thrusting action toward the container which typically raises dust. Dust propagates to the area of the main center roller also from the inlet to the trash container.

Some street sweepers include an additional or auxiliary brush, in addition to the two side brushes, which is arranged laterally and forwardly of the frame and serves to pick up trash from either the street sides or the sidewalks. This additional brush directs trash toward the two side brushes and moves out of the machine outline to readily reach also difficult-to-clean spots with just the two side brushes which equip the machine.

A first drawback of the machines just described is that they are too bulky, on account of said requirements for a large size trash container, large capacity water storage tank, comfortable driver's cab, and of the trash-directing devices. Bulk is objectionable because it interferes with fast manoeuvers to reach all spots to be cleaned and negotiate any obstacles. The bulk of such machines also causes problems with normal street traffic.

Another drawback of known type sweepers is that the main center roller, albeit assisted in its function of thrusting trash into the container by a suitable device, tends to build up trash within the container in a close-by area. Thus, trash is not deposited evenly over the container bottom, failing to utilize the full capacity thereof, and the trash build-up tends to hinder the entrance of more trash.

It should be further noted that in spite of the water sprinkling arrangement the rotating brushes and roller raise dust in large amounts, which dust is diffused through the air and cannot be directed into the container and is later deposited back over the ground. Furthermore, in cold climates or during the winter season, the use of water to attenuate dust raising creates the so-called "varnish effect", that is, formation of thin ice layers.

Not the least of its drawbacks is that said additional brush is only adapted to operate on one side of the machine, thus requiring inconvenient and difficult manoeuvering by the operator to get, for example, at trash on the opposite side of the street with respect to the sweeper travel direction.

SUMMARY OF THE INVENTION

In view of the above situation, it is the technical aim of this invention to provide a street sweeper for trash collecting which can substantially obviate the drawback listed above.

Within the above technical aim it is an important object of this invention to provide a sweeper which, while having a large load capacity and working range, is compact in size.

Another important object is to provide a sweeper wherein trash is made to be so laid inside the trash container as to afford good utilization of the available space and easily carried out operations for loading such trash.

A further important object of this invention is to provide a street sweeper which can minimize, in operation, dust spreading through the air, and also collect dust inside the trash container.

Another object of the invention is to provide a street sweeper which only requires a very small amount of sprinkled water for its operation, thereby it can also operate satisfactorily in cold climate places or in winter time.

A not least object of the invention is to provide a sweeper which can operate and pick up trash over a large work surface, definitely larger than the work surfaces which can be cleaned with previously known sweepers.

The outlined technical aim and specified objects are substantially achieved by a street sweeper machine for collecting trash, comprising:

a frame having a forward part and a rear part;

wheels at least partly driving and at least partly steering which support said frame;

power driven rotary brushes supported on said frame in contact with a surface to be swept, for directing said trash;

a driver's cab carried on said forward part of said frame;

a trash container supported on said rear part of said frame and having a partition wall facing said cab and an opening formed through said partition wall;

a water tank and a trash conveyor supported on said frame and being inserted between said cab and container, said conveyor extending between a top end thereof in communication with said opening in said container and a bottom end thereof substantially level with said brushes and adapted to receive trash being conveyed from the brushes themselves; and suction members supported on said frame and in communication with the interior of said container for drawing in dust through said opening and from said conveyor.

BRIEF DESCRIPTION OF THE DRAWINGS

Further features and advantages of the invention will become apparent from the following description of a preferred embodiment of the street sweeper of this invention, as shown in the accompanying drawings, where.

DESCRIPTION OF THE PREFERRED EMBODIMENT

Figure 1:
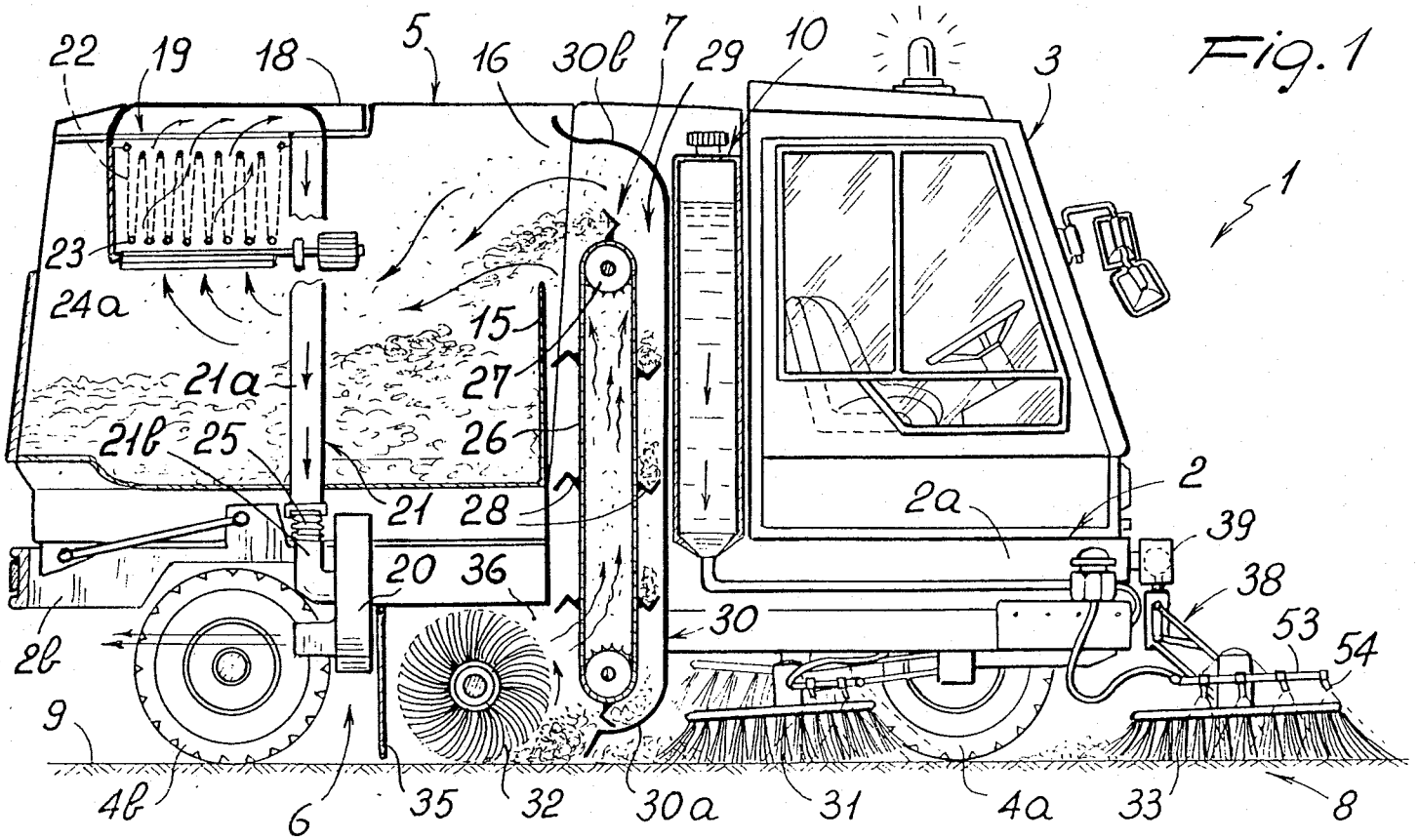
FIG. 1 is a side elevation partly cut-away view of the sweeper.

With reference to the cited drawing figures, the sweeper of this invention is designated 1.

Briefly, the sweeper 1 comprises a frame 2 having a forward part **2*a* and a rear part 2*b*. The forward part 2*a* is rigid upwardly with a driver's cab 3 and downwardly with a single steering wheel 4*a* in order to drive the street sweeper 1** along very small radius bends.

The rear part **2*b* is engaged upwardly with a trash container 5, to which a dust suction unit is connected, and downwardly with two driving wheels 4*b* which are suitably powered. In the illustrated instance, a motor is provided for moving the machine which is located on the frame 2 underneath the container 5**.

Between the cab 3 and the container 5, there is a trash conveyor 7, which conveys trash into the container 5.

The conveyor 7 is fed from brushes 8 located under the frame 2 in contact with the street surface 9, which may also be a large industrial yard to be swept clean.

Between the cab 3 and the container 5, there is also arranged a water storage tank 10 forming a part of a water delivery system, as explained hereinafter.

Figure 7:
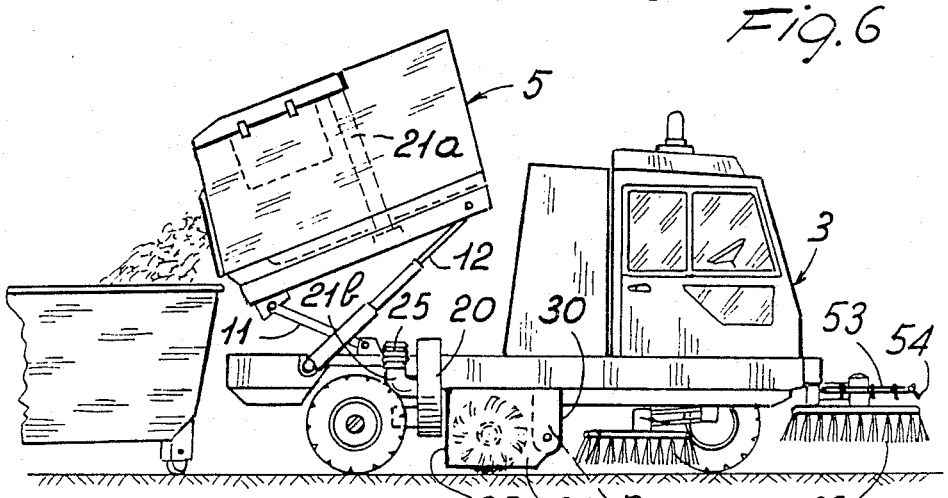
FIG. 7 shows how the trash container can be raised and tilted for the unloading operations.

More specifically, the container 5 is a large capacity one, having a capacity of about three cubic meters, for example, and is engaged with the frame 2 through swivel rods 11 (FIG. 7) and at least one fluid-operated piston 12 capable of effecting lifting and partial tilting of the container 5 to unload trash into specially arranged containers. Unloading is carried out by means of a special unloading gate 13 located rearwardly on the machine 1, through a bottom wall 14.

On the remote side from the bottom wall 14, there is arranged a partition wall 15, relatively close to the cab 3, which extends vertically and perpendicularly to the surface 9 and has an opening 16 at the top. The container 5 has a roof 17 equipped with a removable portion 18 connected to the dust suction unit dust 6.

The dust suction unit 6 comprises a bank 19 of filters carried on the removable portion 18 of the roof 17, a turbine 20 attached to the frame 2, and a suction conduit 21 which extends mainly within the container 5, between the bank 19 and the suction mouth of the turbine 20.

The turbine 20 is adapted to maintain a vacuum inside the container 5, which is connected to the conveyor 7 through the opening 16. By way of example, a flow rate of about two thousand cubic meters per hour is envisaged for the turbine 20.

The filter bank 19 comprise a porous cloth 22, in particular an acrylic cloth having an area of about twentyfive square meters and capable of filtering out particles down to a three-micron size, which is set to form pockets or bends by the action of tensioner links 23 formed by small rods. The bends or pockets are vertical and the links, located at a lower level, are engaged by a power driven shaker 24, which rotates on command a crosspiece **24*a* which has a cam-like cross-section and strikes the lowermost links 23** at each revolution.

The suction conduit 21 is subdivided into two consecutive sections which define a first movable portion **21*a*, rigid with the container 5 and raisable therewith (FIG. 7), and a second portion 21*b* rigid with the turbine 20, in turn attached to the frame 2. Between said two portions there is inserted an airtight bellows 25 engaged with the portion 21*b***.

The conveyor 7 is close against the container 5, is substantially flattened in the lengthwise direction of the street sweeper, and extends almost across the frame 2 width. In height, the conveyor 7 extends perpendicularly to the surface 9, between a bottom end level with the brushes 8 and a top end level with the opening 16, formed in the partition wall 15.

Figure 2:
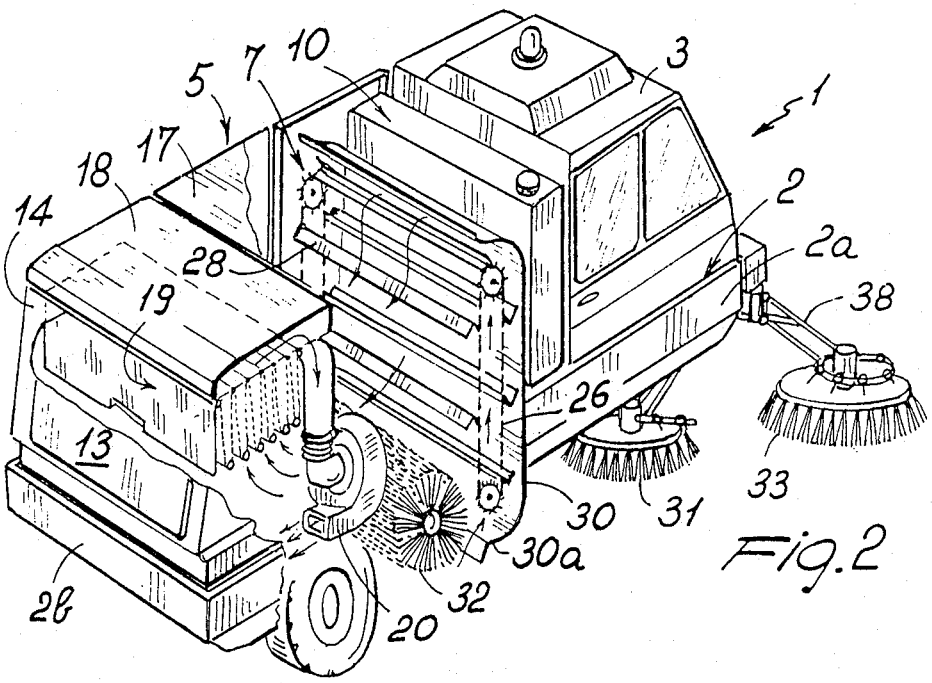
FIG. 2 is a perspective cut-away view of the sweeper shown in FIG. 1.

The conveyor 7 structure is an open one, as brought out in FIG. 2, to allow a suction air stream therethrough, and is formed by two supporting and guiding chains 26, set apart from each other and stretched into a loop. The sprocket wheels 27 are power driven, and mesh with the chains 26 to drive and deflect them. A plurality of transport paddles 28 are attached to the chains 26 and set apart from one another. A specially provided chain tensioner device, not shown, keeps the chains 26 well stretched to prevent any oscillations of the paddles 28.

The chains 26 and sprocket wheels 27 are so arranged as to form for the paddles 28 an ascending run and a descending run which are parallel to each other and set apart, a lower trash pick-up run, and an upper throw run whereat the trash is thrown into the container 5 through the opening 16.

A transport channel 29 borders the conveyor 7 and is also vertical. The transport channel 29 acts as a guide for the suction air stream flowing across the conveyor 7.

A wall of the transport channel 29 is formed by the partition wall 15. Remotely from the latter there is a shaped wall 30 having flexible end sections bent to partly surround the transport channel 29. There may be distinguished, in fact, a lower section **30*a* and an upper section 30*b*. The upper section 30*b* can be swung out to allow for the container 5 lifting, and the lower section 30***a* can be swung out to allow trash through and has both faces in contact with the trash, as brought out in FIG. 1.

In fact, the face not confronting the ground forms a guide or chute for the trash material toward the conveyor 7.

The brushes 8, acting on the surface 9, are below the frame 2, at the forward and middle parts thereof.

They comprise two side brushes 31 of cup-like shape, a main center roller 32 having its rotation axis parallel to the surface 9, and an additional auxiliary front brush 33, also cup-like in shape.

Figure 6:
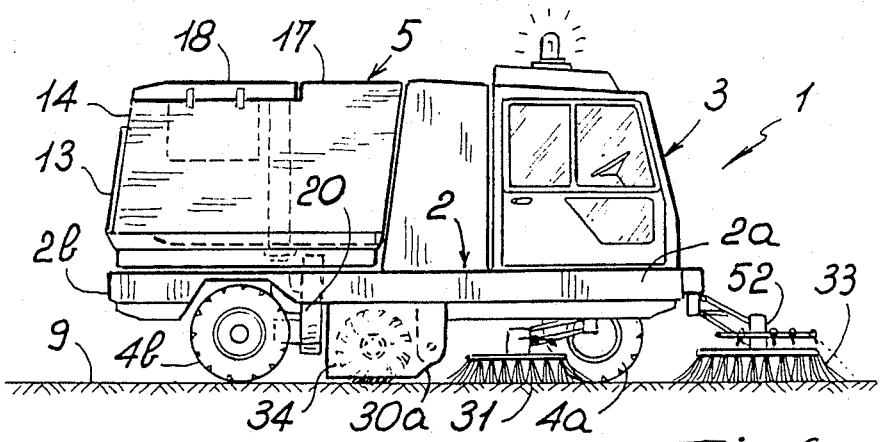

The side brushes 31 counter-rotate with respect to each other to direct trash toward the center roller 32. The center roller 32 turns in the opposite direction with respect to the wheels 4*a*, 4*b* as the machine 1 moves forward, and is located rearwardly with respect to the bottom end of the conveyor 7 toward which it throws the trash material. It should be noted that the center roller 32 and the bottom end of the conveyor 7 are bordered by longitudinal bulkheads 34 along the longitudinal sides of the machine 1 (FIGS. 6 and 7), a cross bulkhead 35 on the rear of the center roller 32 (FIG. 1), and the lower section 30*b* of the shaped wall 30 at the front of the conveyor 7 (FIGS. 1 and 2). It follows that the main roller 32 and the bottom end of the conveyor 7 are inserted into a housing 36 which is substantially closed laterally by flexible bulkheads.

Figure 3:
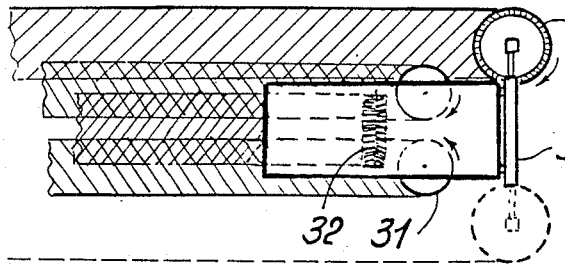
FIG. 3 brings out the work areas of the machine brushes and how such areas combine together.
Figure 4:
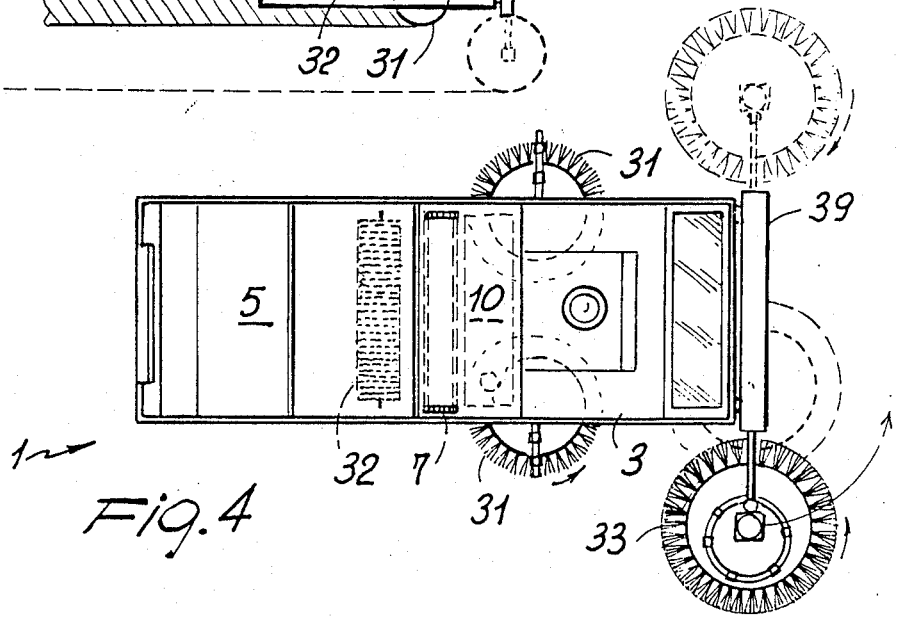
FIGS. 4,5 and 6 are plan, front, and side views, respectively, of the sweeper showing the various operating settings of an additional front brush.
Figure 5:
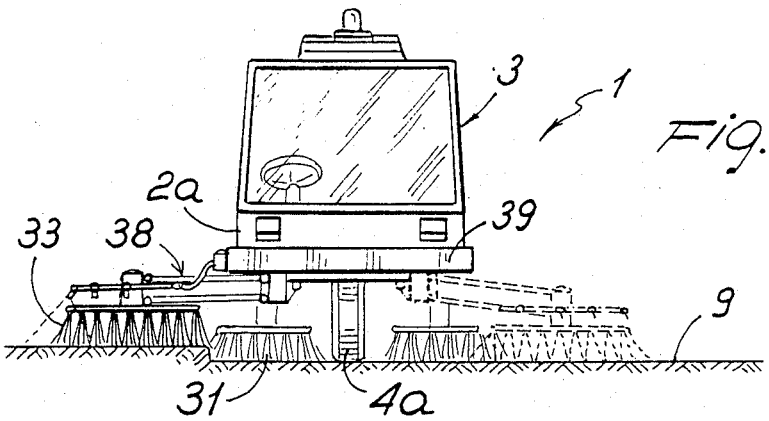

The auxiliary brush 33 may be shifted on command by an operator across the forward part 2*a* of the sweeper 1 between spaced apart and differentiated work areas, as FIGS. 3, 4 and 5 bring out. The movements are controlled through a drive 37 shown in FIGS. 8 and 9, which operates an arm 38 directly and rotatively which carries the auxiliary brush 33.

The drive 37 comprises a slideway 39, a carriage 40, and a turning device 41.

The slideway 39 engages the entire forward end of the frame 2, extends across the same (FIG. 5), and is formed from a tubular element.

The carriage 40 is inserted in the slideway 39, supports the arm 38 through a small shaft 42 perpendicular to the surface to be swept, and accommodates the turning device 41 on its interior which acts on the small shaft 42. The carriage 40 is driven by a piston 43 external of the slideway 39.

The turning device 41 comprises a turning cylinder 44 which acts through a connecting rod 44*a* on a set of gears 45 ending rigidly with the shaft 42. The arm 38 is made fast with the latter.

Figures 8, 9:
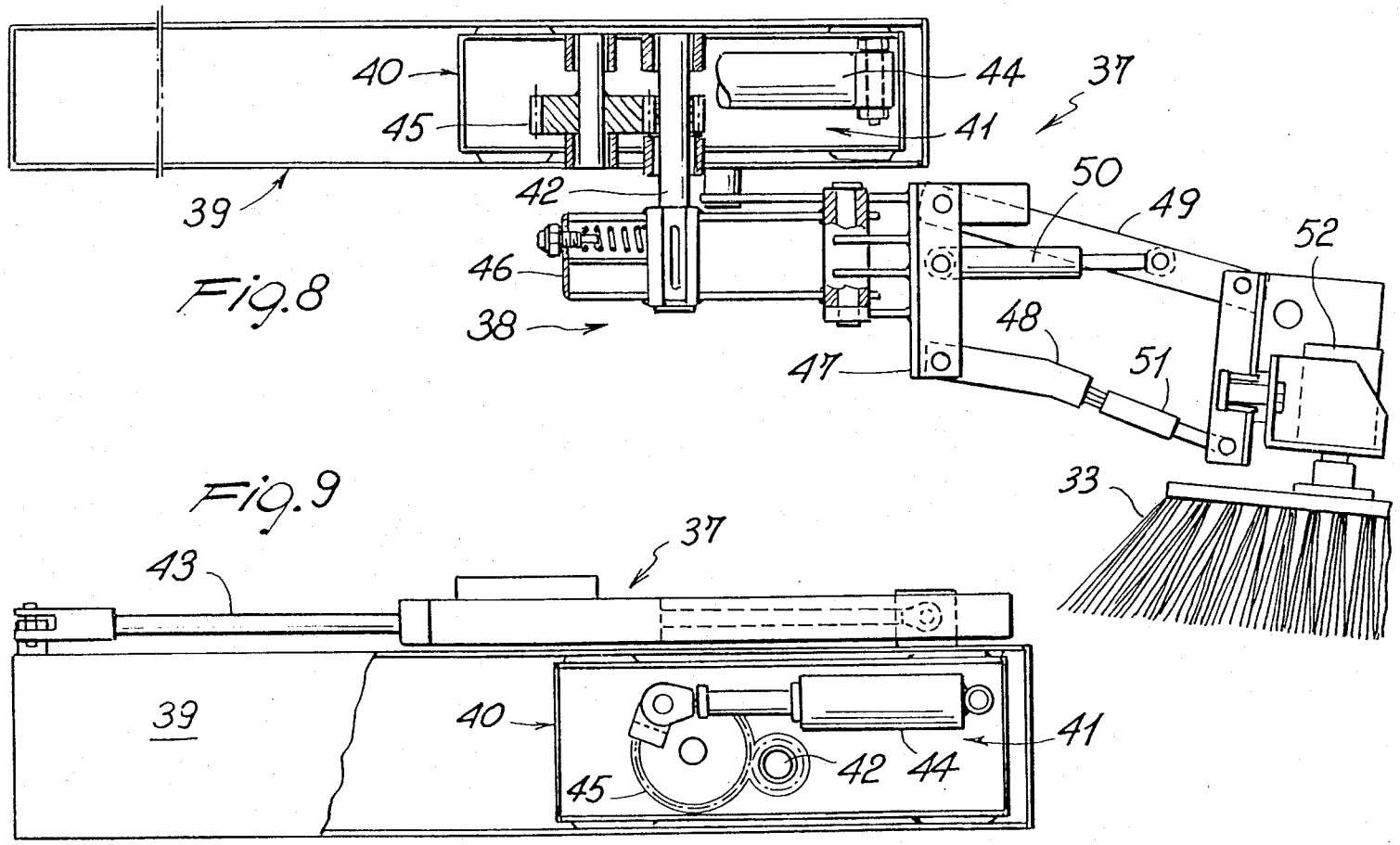
FIGS. 8 and 9 are a vertical longitudinal section and a partly cut-away plan view, respectively, showing a drive for the additional front brush.

As FIG. 9 brings out in particular, the arm 38 has an initial section 46 which may be positioned in an axial direction to the shaft 42, to permit adjustment of the arm reach and stowage of the auxiliary brush 33 in a position close against the machine outline (FIG. 4) in the rest condition, and a terminating section defined by a quadrilateral linkage 47. The latter may be swung in a vertical plane parallel to the small shaft 42 and comprises a lower arm 48, an upper arm 49, and a piston 50 for changing the position of the upper arm 49 and the quadrilateral linkage as a whole. Also provided is a member 51 for adjusting the length of the lower arm 48 in order to only change the auxiliary brush 33 inclination.

A motor 52, mounted directly on the auxiliary brush 33, drives the brush rotatively in operation.

The tank 10 is reduced dimensions substantially flattened with respect to the machine lengthwise direction and set close against the cab 3 to insulate same both acoustically and thermally from the conveyor 7. It forms a part of water delivery members which also comprise, in a known manner, a pump, gutters 53 for the water, and a plurality of nozzles 54 which may be advantageously provided only at the cup-like brushes 31,33 to attenuate dust raising, to the exclusion, therefore, of the roller 32, already affected by a suction airflow. The figures bring out that on said brushes the nozzles 54 are arranged along circumferentially extending gutters 53.

The sweeper operates as follows.

As brought out in FIGS. 3, 4 and 5, an operator can position as desired the auxiliary brush 33 while driving the machine forward, thereby performing immediately all the necessary cleaning operations over large surfaces. In particular the operator can establish the correct height of the auxiliary brush 33 above the ground by acting on the piston 50, which will change the position of the upper arm 49 and of the lower arm 48, as permitted by the quadrilateral linkage 47.

If the arms 48 and 49 have different lengths, the inclination of the auxiliary brush 33 changes with its height above the ground, but in every case the operator can adjust also the member 51, in order to set the right inclination of the auxiliary brush 33 with respect to the ground, for directing the trash material toward the side brushes 31 and then toward the roller 32, after passing below the flexible bottom section 30*a* of the shaped wall 30.

The roller 32 turns in the opposite direction to the wheel forward direction, and accordingly, throws the received trash back forward forcing it to move over the cited lower section 30*a* within the reach of the bottom end of the conveyor 7 and its paddles 28.

The paddles 28 go through a pick-up path away from the roller 32, and then an ascending run close to, but not contacting, the shaped wall 30. The vertical movement allows the trash material brought in by the paddles 28 to also require no resting against the shaped wall 30, with the consequent possibility of reducing friction and achieving a fast movement.

The ascending run takes the trash to a much raised position with respect to the loading platform of the container 5, thereby affording full utilization of the available loading capacity. Even with the container 5 nearly filled up, it is still possible to effect loading operations.

Then, a distance of throwing the trash into the container 5 through the opening 16 is covered, as brought out in FIG. 1, and the paddles 28 are then moved back toward the roller 32 completing the descending run of their path.

The loading operations are greatly facilitated by a strong suction air stream which also directs into the container 5 dust and other particles. The air stream is generated by the turbine 20 which draws air from inside the container 5, through the filter set 19. The latter prevents the dust from being thrown back out of the machine.

Despite the presence of the conveyor 7, the air stream also acts at the level of the surface 9 to be swept on account of the concurrent presence of an open structure in the conveyor 7, of a transport channel 29 surrounding the conveyor exterior, and of a housing 36 enclosing the roller 32 and the bottom end of the conveyor. In practice, a broad suction assembly is formed which extends from the container 5 to the surface 9 and encloses originally the conveyor 7 and roller 32.

The presence of the turbine 20 does not encumber the container 5, nor does it hinder its tilting movement, owing to the presence of a suction conduit which is divided into two portions removable from each other.

The strong suction effect afforded makes sprinkling the surface 9 with water largely unnecessary to trap down dust. It is then envisaged that the nozzles 54 be only located over the cup-like brushes 31 and 33. Thus, on the one side, substantial elimination of the drawbacks connected with sprinkling streets with water, and on the other side the possibility of making the tank 10 with a relatively smaller capacity, are achieved to make the sweeper more compact. The location of the tank is also effective to insulate the cab 3.

The size reduction is also achieved through the flattened vertical shapes of the tank 10 and conveyor 7, and by that the height of the conveyor 7 also allows the use of tall design containers 5 since filling takes place from the top.

The arrangement of the conveyor, tank, brushes, and turbine is advantageous also because such members are not in close contact with the wheels, do not come out of the machine outline (with the deliberate exception of the auxiliary brush 33), and do not interfere with the raising of the container 5.

Where the container 5 is equipped with piping for well and drain well cleaning, and with related suction pumps for said piping, the existing suction air stream produced by the turbine 20 makes also these operations highly effective and easily carried out, because the suction effect of the turbine adds to the action of the cited pumps for said piping.

I claim:

1. A street sweeper machine for collecting trash, comprising a frame having a forward part and a rear part, wheels which support and move the frame, a driver's cab carried on said forward part of said frame, a trash container supported on said rear part of said frame and having a partition wall facing said cab and an opening formed through said partition wall, a water storage tank and a trash conveyor supported on said frame and being inserted between said cab and container, power driven rotary brushes supported on said frame in contact with a surface to be swept, for directing said trash to said trash conveyor, said conveyor extending between a top end thereof in communication with said opening in said container and a bottom end thereof substantially level with said brushes, said conveyor with said bottom end thereof being adapted to receive trash being conveyed from the brushes themselves, and a dust suction unit supported on said frame and in communication with the interior of said container for drawing in through said opening dust raised by said brushes and from said conveyor.

2. A sweeper machine according to claim 1, wherein said tank and said conveyor are laid side-by-side and are of reduced dimensions with respect to a lengthwise direction of the machine, each extending effectively across the full width of said frame, and said tank is located close against said cab and said conveyor is located close against said partition wall in said container.

3. A sweeper machine according to claim 1, wherein said conveyor has an open structure to allow passage of a stream of air across the conveyor as a result of said suction unit and comprises a plurality of transport paddles spaced apart from one another, a plurality of chains attached to said paddles, and a plurality of sprocket wheels meshing with said chains wherein at least some of said sprocket wheels are power driven, and said conveyor with said chains and sprocket wheels defining for said paddles an ascending run and a descending run spaced apart from each other, a trash pick-up bottom run, and trash throwing upper run for throwing said trash into said container through said opening.

4. A sweeper machine according to claim 3, wherein said conveyor mainly extends substantially perpendicularly to the surface to be swept, and wherein a transport channel is provided which surrounds at least said ascending and descending runs of said paddles to act as a guide for and air stream flowing across said conveyor.

5. A sweeper machine according to claim 4, wherein said transport channel comprises a shaped wall flanking said ascending end of said conveyor of said paddles and defining a trash guide at said bottom run.

6. A sweeper machine according to claim 1, wherein said dust suction unit comprises a turbine made fast with said rear part of said frame, a suction conduit extending between said turbine and said container, and at least one filter bank located at a raised position in said container, a first side of said filter bank being in communication with the container interior, and on the other side in communication with said suction conduit.

7. A sweeper machine according to claim 6, wherein said filter bank is defined by a porous cloth folded into bends, a plurality of links engaging said cloth, and a power driven shaker acting on said links.

8. A sweeper machine according to claim 6, wherein said container is raisable and tiltable on command, and wherein said suction conduit has a first portion movable with said container, a second portion rigid with said turbine, and a sealing bellows inserted between said portions.

9. A sweeper machine according to claim 1, wherein said brushes comprise a main center roller for throwing said trash toward said bottom end of said conveyor, and wherein a housing is provided underneath said frame which is bordered laterally and houses said roller and said bottom end of said conveyor.

10. A sweeper machine according to claim 9, wherein said roller has an opposite direction of rotation to a forward travel direction of said wheels and is located rearwardly, with respect to the forward travel direction, of said bottom end of said conveyor, and wherein a shaped wall partly surrounds said conveyor, on the side thereof which is farthest from said roller, and is inclined at an end thereof toward said roller to define a trash guide to said conveyor.

11. A sweeper machine according to claim 1, wherein said brushes comprise a main center roller for throwing said trash toward said conveyor, two side brushes for directing said trash to underneath said frame and towards said main center roller, and an auxiliary front brush positionable on command across said forward part of said frame.

12. A sweeper machine according to claim 11, wherein to position said auxiliary brush on command there are provided a slideway extending along said forward part of said frame, crosswise to same, a carriage movable along said slideway, a piston for driving said carriage, a small shaft substantially perpendicular to the surface to be swept and projecting from said carriage, a turning device carried on said carriage and adapted to turn said small shaft about its axis, an arm comprising a quadrilateral linkage which swings in a vertical plane and supports said auxiliary brush rotatively, and a rotation motor connected directly to said auxiliary brush for rotating same.

* * * * *